US012790726B2

(12) United States Patent
Grappe et al.

(10) Patent No.: US 12,790,726 B2
(45) Date of Patent: Nov. 10, 2026

(54) APPARATUS AND METHOD FOR MICROWAVE CARBONIZATION OF POLYMERIC MATERIALS FOR CARBON FIBER PRODUCTION

(71) Applicants: Hippolyte A. Grappe, Copenhagen (DK); Felix L. Paulauskas, Knoxville, TN (US)

(72) Inventors: Hippolyte A. Grappe, Copenhagen (DK); Felix L. Paulauskas, Knoxville, TN (US)

( * ) Notice: Subject to any disclaimer, the term of this patent is extended or adjusted under 35 U.S.C. 154(b) by 381 days.

(21) Appl. No.: 18/583,847

(22) Filed: Feb. 21, 2024

(65) Prior Publication Data

US 2024/0247412 A1 Jul. 25, 2024

Related U.S. Application Data

(63) Continuation-in-part of application No. 17/902,818, filed on Sep. 3, 2022, and a continuation-in-part of (Continued)

(51) Int. Cl.
*D01F 9/32* (2006.01)

(52) U.S. Cl.
CPC ..... *D01F 9/328* (2013.01); *D10B 2101/12* (2013.01)

(58) Field of Classification Search
CPC ... D01F 9/328; D01F 9/32; D01F 9/14; D01F 9/00; D01F 9/08; D01F 9/12; D01F 9/324;
(Continued)

(56) References Cited

U.S. PATENT DOCUMENTS 3,607,062 A * 9/1971 Sudduth ..... C10L 9/08 432/15
4,197,282 A 4/1980 Bailly-Lacresse et al.
(Continued)

FOREIGN PATENT DOCUMENTS

JP 5191004 4/2013

OTHER PUBLICATIONS

Lebedev, Some properties of the tunable cavity microwave plasma source, Plasma Sources Sci. Technol. 1995; 4: 474-481 (Year: 1995).*

*Primary Examiner* — Daniel C. Mccracken
(74) *Attorney, Agent, or Firm* — Robert J Lauf

(57) ABSTRACT

An apparatus is disclosed for electromagnetically and thermally treating polymeric materials, including PAN and other carbon fiber precursors at large scale at atmospheric pressure, while measuring the temperature in the closed environment of the process chamber. The apparatus is designed for continuous processing, and to be compatible with other stages of existing carbon fiber production lines. It provides direct electromagnetic coupling to the fiber tow(s) in a resonant cavity of one or more microwave waveguide launchers and also provides direct radiative or IR heating from susceptor plates located on the opposite side of the tow from the waveguide opening for processing a band of multiple tows of fiber. It produces high-temperature-carbonized (HTC) fiber with shorter residence time and higher density compared to the conventional process. Its design is inherently scalable to larger production.

21 Claims, 11 Drawing Sheets

Related U.S. Application Data application No. 17/902,815, filed on Sep. 3, 2022, now Pat. No. 12,618,175.

(58) Field of Classification Search

CPC ..... D01F 9/326; D01F 11/00; D01F 11/02; D01F 11/04; D01F 11/06; D01F 11/08; D01F 11/10; D01F 11/12; D01F 11/121; D01F 11/122; D01F 11/123; D01F 11/124; D01F 11/125; D01F 11/126; D01F 11/127; D01F 11/128; D01F 11/129; D01F 11/14; D01F 11/16; D10B 2101/12

See application file for complete search history.

(56) References Cited

U.S. PATENT DOCUMENTS

| | | | | |
|---|---|---|---|---|
| 6,372,192 | B1 * | 4/2002 | Paulauskas | D01F 9/12 423/447.7 |
| 6,375,875 | B1 * | 4/2002 | Paulauskas | G01N 22/00 425/464 |
| 6,514,449 | B1 * | 2/2003 | Paulauskas | B29C 70/54 264/483 |
| 7,824,495 | B1 * | 11/2010 | White | D06M 10/025 118/723 MW |
| 9,427,720 | B2 | 8/2016 | White et al. | |
| 9,745,671 | B2 | 8/2017 | Suzuki et al. | |
| 10,260,173 | B2 | 4/2019 | Zushi et al. | |
| 2020/0056306 | A1 | 2/2020 | Kim et al. | |
| 2021/0115598 | A1 | 4/2021 | Shin et al. | |

* cited by examiner

PRIOR ART FIG. 1

APPARATUS AND METHOD FOR MICROWAVE CARBONIZATION OF POLYMERIC MATERIALS FOR CARBON FIBER PRODUCTION

CROSS REFERENCE TO RELATED APPLICATIONS

This application is a Continuation-in-Part of U.S. patent application Ser. No. 17/902,815 entitled, "Apparatus and Method for Close Proximity Carbonization of Polymeric Materials for Carbon Fiber Production", filed by the present inventors on Sep. 3, 2022, the entire disclosure of which is incorporated herein by reference. This application is also a Continuation-in-Part of U.S. patent application Ser. No. 17/902,818 entitled, "Apparatus and Method for Microwave Carbonization of Polymeric Materials for Carbon Fiber Production", filed by the present inventors on Sep. 3, 2022, the entire disclosure of which is incorporated herein by reference.

STATEMENT REGARDING FEDERALLY SPONSORED RESEARCH

This invention was made with Government support under Contract No. DE-AC05-00OR22725 awarded by the U.S. Department of Energy to UT-Batelle LLC, and the Government has certain rights in this invention.

BACKGROUND OF THE INVENTION

Field of the Invention

The invention pertains to apparatus and methods for manufacturing carbon fiber, and more particularly, to apparatus and methods for carbonizing polymeric fibers in a resonant microwave cavity using electromagnetic treatment along with infrared heating with the help of a material used as a susceptor.

Description of Related Art

Carbon fiber is a high-performance material which can reach tensile strength properties of 700 ksi or more while having a density that rarely exceeds 1.8 g/cm$^3$. In comparison, regular and high-performance steels have densities typically between 7.7 and 8.0 g/cm$^3$ and tensile strength performance around half that of carbon fiber (CF). Carbon fiber provides high specific stiffness and strength and is very attractive for weight-critical applications. However, this comes at a high cost and thus is used in structures in which the performance justifies the high-cost premium. Carbon fiber has seen limited use in heavy vehicles and automotive passenger platforms as well as in other industries where its use offers weight reduction, performance and energy efficiency gains. To be massively adopted in those industries, the price of carbon fiber must be reduced by half. It is generally observed that commercial grade carbon fiber production cost is about evenly divided between the cost of the precursor and the cost of converting the precursor to carbon fiber. The high temperature carbonization stage is one of the most energy intensive conversion steps. Significantly reducing the energy consumption of high temperature carbonization (HTC) per unit mass of throughput would allow the carbon fiber to be one step closer to broader adoption in the industry.

FIG. 1 shows a diagram of all steps encountered by the material in a conventional line of conversion as in the current industry: pretreatments, stabilization/oxidation, low temperature carbonization, high temperature carbonization, graphitization (optional), surface treatment, and sizing. The high temperature carbonization (outlined by the dashed line in FIG. 1) is the second step of carbonization, where final carbon fiber properties are determined, and total carbon content typically exceeds 95% of the fiber exiting the HTC process.

Carbon fiber is produced from a variety of precursors. The predominant raw materials are polyacrylonitrile (PAN), mesophase pitch, and rayon. Natural precursors such as cellulose or lignin also exist but are not commonly used in the industry. In most cases, the precursor is spun in tows of continuous filaments. It may then be pre-stretched before being stabilized in an oxidative environment (usually in air at 200 °C-400 °C for several hours, with the required time being dependent upon precursor used. It can range from ninety minutes to several hours). After the stabilization process, the material becomes a thermoset. It is matte black, infusible, flameproof, and is usually referred to as "oxidized fiber". This oxidized fiber is sufficiently stable for exposure to significantly higher carbonization temperatures and graphitization under an inert environment, usually nitrogen. The carbonization process is divided into two or three stages. The first carbonization stage is low temperature carbonization (LTC) and operates in the 350 to 800 °C temperature range. The second carbonization stage is high temperature carbonization (HTC). This second stage thermally treats the fiber between 800 °C and 1500 °C.

Optionally, carbon fiber can be given a third and final thermal treatment between 2000 °C and 3000 °C, referred to as graphitization. In this last stage the fiber acquires a graphite-like structure while losing almost all its impurities and experiencing a negligible weight variation. To some extent, the Young's modulus is function of the highest temperature the fiber has been exposed during the graphitization stage. Thus, graphitization produces carbon fiber with extremely high stiffness.

Once the material is fully carbonized, the carbon fiber's surface is conditioned to obtain the final product by dipping it in an electrolytic or acidic bath. The fiber, configured as an anode, travels between cathodes made of graphite. Finally, the tow is coated with a selected sizing for creating the right interface with the future resin in the composite, handleability, and packaging purposes.

Electromagnetic (EM) energy sources, i.e. microwave (MW), for material processing and carbon fiber conversion have been used since the 1970s. The application and the efficiency of EM as an energy source is highly dependent on the design of the processing chamber, power transmission line, the geometry of the antenna system relative to the load, modes, pattern of radiation, management and control of the energy inside the chamber (i.e., control of reflections), yield efficiency, sustainability, resonance, and in general, the overall configuration of the hardware processing system or applicator.

Among the earliest work using EM energy source for carbon fiber precursor conversion is reported in the Japanese Pat. Specification No. 4,724,186, published on Jul. 4, 1972, and natural organic spun material in a batch mode (U.S. Pat. No. 4,197,282, Lacress, et al.). Since then, this energy source has been researched significantly, but never put into commercial production.

Since 2000, the Oak Ridge National Laboratory has been issued several patents related to the carbonization of carbon fiber precursors using a microwave (MW) plasma generated in vacuum. U.S. Pat. No. 6,372,192 to Paulauskas, et al. describes the carbonization of material batches wrapped around a static frame exposed to a plasma. U.S. Pat. No. 6,375,875 to Paulauskas, et al. discloses a technique that uses frequency sweeping in the microwave band to characterize carbon fiber. In addition to using EM power to carbonize material, the dielectric properties of fiber can be measured by radiating with low power EM energy and analyzing the reflection waves. In this last case, MW energy is not used to convert the polymer into carbon fiber.

U.S. Pat. No. 9,427,720 to White, et al. describes a process of comprehensive carbonization for multiple tows in one single stage using plasma generated by MW under vacuum. The oxidized PAN fiber (OPF) material is exposed to a gradient of MW power in an elongated cavity in a low-pressure gas. This cavity features two eyelets, one on each end, so that OPF is fed in one end and processed fiber (fully carbonized CF) exits at the other end. This cavity is subjected to a moderate vacuum. Part of the gas effluent generated while the fiber undergoes thermal conversion is utilized as a plasma working gas to reduce the consumption of nitrogen. Because of the gradient of MW energy along the cavity, the plasma is heterogeneous: the plasma has a higher density toward the exit of the process, whereas, on the entrance side, where the OPF is introduced, the plasma is almost nonexistent. In this region, the MW is predominant. This system has the capability of continuously processing multiple tows simultaneously.

U.S. Pat. No. 10,260,173 to Zushi et al. describes the carbonization of oxidized PAN fiber at atmospheric pressure. This technique uses a cylindrical or a rectangular waveguide as a processing cavity. Furthermore, it uses a conventional heat source at the end of the process. The microwave energy is absorbed by the material along the processing cavity. This technique does not use any susceptor or other microwave absorber. The energy that has not been absorbed by the material is reflected back at the end of the cavity, having a second chance being absorbed by the material, but also creating a standing wave. This method claims the potential of carbonizing the material faster than the conventional process by at least a factor three. However, it seems to be constrained by the geometry of the waveguide in use, limiting this application to narrow tows or a small amount of material (the size of the tow is not disclosed). Multiple tow processing is not disclosed.

U.S. Pat. No. 9,745,671 to Suzuki describes a carbonization method and carbon fiber production method based on plasma generated by microwaves. This method involves a series of up to three furnaces in line, with a gradient of temperature. Two types of furnaces are used: furnaces involving plasma and conventional electric resistive furnaces. A series of examples using multiple combinations of these two types of furnaces is detailed with the processing conditions (when utilized, the plasma furnaces are operating in the 1 to 8 kPa pressure range). This method is comparable to the one described in U.S. Pat. No. 9,427,720 (T. White, et al.) noted above. The main difference between these two patents is the capability in dissociating the carbonization in multiple stages, giving the opportunity of setting individual tension to each of them with the work of Suzuki. The best mechanical properties reported with this method are 5 GPa for the tensile strength and 300 GPa for the tensile modulus.

JP Pat. No. 5,191,004 (2013) describes a continuous process for the production of carbon fibers by applying high frequency electromagnetic waves as the feedstock fiber travels through a cavity. The cavity is configured as a coaxial system where the fiber is the inner conductor. This system is capable of converting oxidized fiber into carbon fiber under inert atmosphere.

Recently U.S. Pat. Appl. Pub. Nos. 2020/0056306 to Kim, et al., and 2021/0115598 to Shin, et al. disclose an apparatus in which a single tow is processed by direct exposure to the MW through a single port and the system further uses a MW susceptor inside a non-resonant cavity. In U.S. Pat. No. 2020/0056306 Kim, et al. describe an apparatus using microwaves for carbon fiber manufacturing. It is claimed that multiple sections of this apparatus can be used in series to 1) stabilize the precursor in one to two hours, and then 2) carbonize the stabilized material with one or more stages by using a susceptor located in the main cavity heated up to the 400-1500 °C range. This susceptor can have multiple shapes and should occupy 0.1% to 5% of the volume of the main cavity. With this method the tensile strength and the modulus of the treated fiber can reach 2.5 GPa and 190 GPa respectively. However, it is difficult to assess the real performance of this invention because the grade of feedstock material is not disclosed (e.g., aerospace grade, commodity grade, or textile grade).

What is needed, therefore, is a system to perform high temperature carbonization of a continuous fiber tow efficiently and reproducibly, and that can be conveniently inserted into existing processing lines.

Objects and Advantages

Objects of the present invention include the following: providing an apparatus for high temperature carbonization of a continuous fiber tow using electromagnetic energy; providing an apparatus for high temperature carbonization of a continuous fiber tow using electromagnetic energy with supplemental radiant heating from a susceptor material in a resonant cavity; providing an apparatus for high temperature carbonization of a continuous fiber tow that yields improved density and reduces processing time; providing an apparatus for carbonization of a continuous fiber tow using electromagnetic energy that produces not only high temperature carbonization but also graphitization; and, providing a more efficient processing method for carbonization of a continuous fiber tow. These and other objects and advantages of the invention will become apparent from consideration of the following specification, read in conjunction with the drawings.

SUMMARY OF THE INVENTION

According to one aspect of the invention, an apparatus for carbonization of fiber materials comprises:

- a power supply and transmission line to provide a source of electromagnetic energy of a selected power and frequency into a waveguide;
- an applicator cavity having an inlet opening and an outlet opening allowing a continuous fiber tow to pass therethrough, and further comprising:
  - at least one open waveguide launcher operable to deliver the electromagnetic energy from the transmission line into the cavity;
  - a body of susceptor material facing the open waveguide launcher and spaced apart therefrom to form a gap through which the continuous fiber tow passes so that the fiber tow material is simultaneously exposed to electromagnetic energy from the open waveguide launcher and to radiant thermal energy from the susceptor body;

at least one movable wall whereby the length of the cavity may be adjusted for efficient tuning; and, at least one temperature measuring device proximate to the susceptor body.

According to another aspect of the invention, a method to carbonize continuous fiber materials includes the steps of:

a) providing a microwave power source and transmission line;

b) providing a tunable microwave cavity having at least one movable wall and further including an inlet opening and an outlet opening through which a continuous fiber tow passes through the microwave cavity;

c) providing an open waveguide launcher through which microwave energy is delivered into the cavity;

d) positioning a body of susceptor material opposite the open waveguide launcher and spaced sufficiently therefrom to form a gap through which the fiber tow passes;

e) tuning the cavity by moving at least one end wall to minimize power reflected from the cavity into the waveguide; and, f) pulling the fiber tow through the cavity at a selected speed and tension while applying microwave energy so that the fiber tow is simultaneously subjected to microwave energy from the launcher and to radiant heating from the susceptor material so that a desired level of carbonization is achieved.

BRIEF DESCRIPTION OF THE DRAWINGS

The drawings accompanying and forming part of this specification are included to depict certain aspects of the invention. A clearer conception of the invention, and of the components and operation of systems provided with the invention, will become more readily apparent by referring to the exemplary, and therefore non-limiting embodiments illustrated in the drawing figures, wherein like numerals (if they occur in more than one view) designate the same elements. The features in the drawings are not necessarily drawn to scale.

DETAILED DESCRIPTION OF THE INVENTION

The present invention is a microwave-based process that replaces the conventional high temperature carbonization (HTC) stage while producing carbon fiber with comparable mechanical properties. Applicants' co-pending U.S. patent application Ser. Nos. 17/902,815 and 17/902,818 describe microwave-based low temperature carbonization (LTC) processes. In the first case, '815, a pair of antennas are placed within a resonant cavity defined by two antennas to focus the microwave energy and generate strong E field regions along a moving tow of oxidized PAN fiber. A heated atmosphere is provided to heat the tow and improve coupling of microwave energy thereto. In the second case, '818, multiple waveguide launchers are positioned along a processing path; each has a susceptor plate positioned opposite the launcher with the fiber passing in between so that the fiber tow is subjected to a combination of direct MW energy from the launcher and radiant (IR) energy from the susceptor plate. Because of the close spacing between the launcher and the susceptor plate, the system is essentially a near-field applicator configuration and Applicants do not believe that significant resonances or standing waves exist along the length of the process chamber, or that such resonances contribute materially to the overall process. As used herein, the term "susceptor" refers to any material having a sufficiently high loss tangent that it can readily absorb microwave energy and become hot. Materials containing silicon carbide, for example, are well known and their use as susceptors has long been documented in many hybrid microwave heating systems; however, various other materials may be used depending on the temperatures involved and other engineering details of a particular application.

Figure 1:
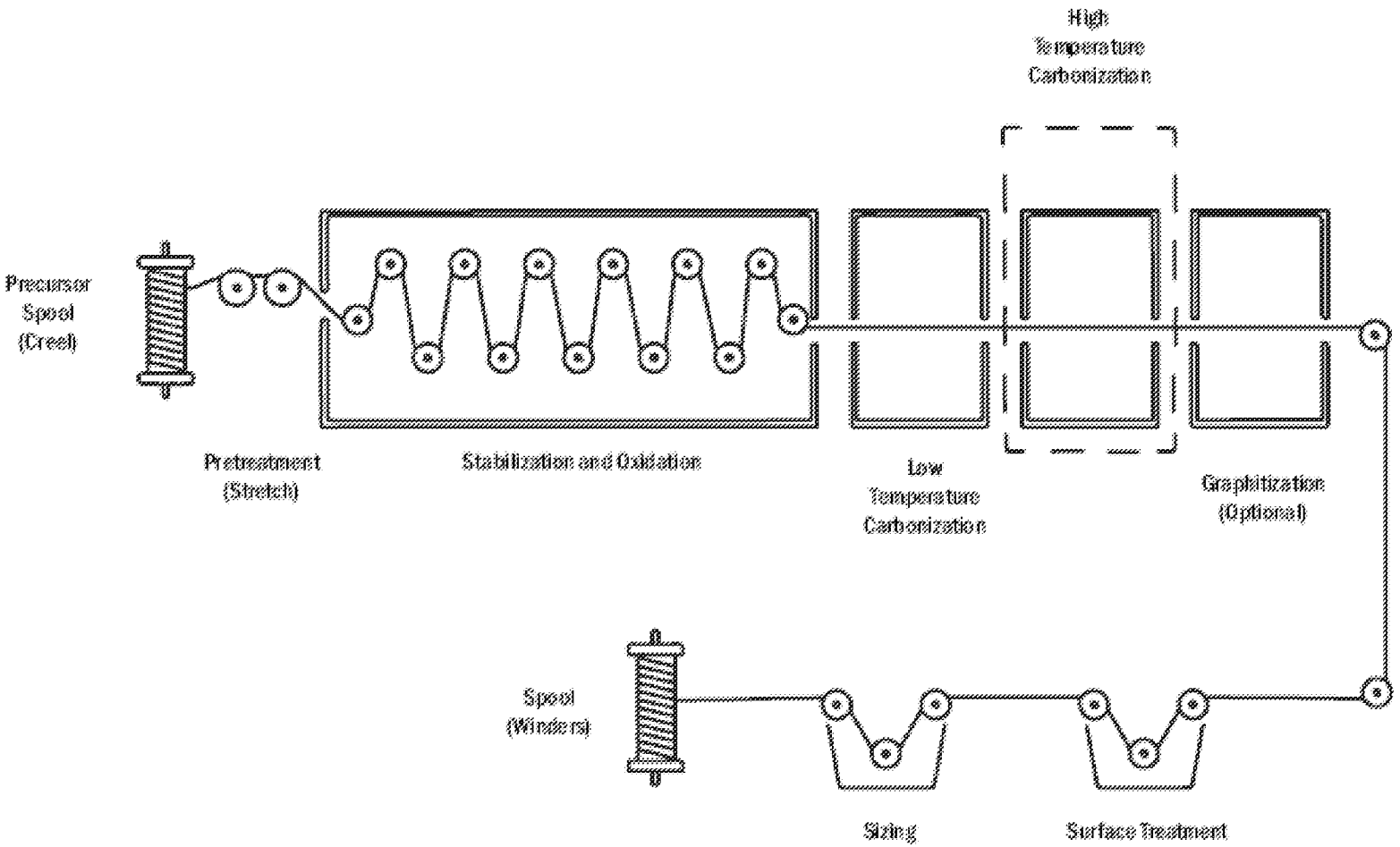
FIG. 1 is a schematic diagram of conventional carbon fiber processing steps according to the Prior Art.

The present invention is directed to MW-assisted high temperature carbonization. Applicants realized that significant differences in microwave behavior between LTC and HTC processes will arise from the fact that the materials being treated (oxidized precursor fibers versus fibers that have already undergone LTC treatment) have very different electrical properties (conductivity and dielectric loss factor). Thus, the inventive HTC apparatus operates at a higher power density compared to the previously mentioned LTC systems. The primary mechanism for the HTC applicator is based on concepts derived from the two different configurations developed for LTC, providing a novel pattern of radiation while still operating at atmospheric pressure. Although the invention is directed primarily to a MW-based replacement for the HTC stage in fiber processing (FIG. 1), Applicants contemplate that in some cases the invention may be further extended to the graphitization step as well.

Electromagnetic processing is, in general, characterized by direct deposition of energy into the material by dielectric coupling. This leads to faster and more efficient energy deposition than conventional processing, if the dielectric properties are adequately aligned with the coupling requirements. This was the case with Applicants' co-pending LTC inventions. However, with HTC, the feedstock material shows different dielectric properties, since the polymer has already been exposed to a thermal treatment and some carbonization, making the fiber electrically conductive to a significant degree. This critical difference must be considered in developing an apparatus and method for a MW-based HTC process. Applicants' co-pending MW-assisted LTC processes reduced the residence time to less than a minute (compared to 90 seconds or more for conventional processing), so the present invention is directed to extending these gains to the HTC stage of carbon fiber production.

It will be appreciated that carbon fiber production includes many different fiber precursor materials that are selected based on performance and cost requirements. These may include: polyacrylonitrile (PAN), pitch, rayon, polyolefins (nylon, polyethylene, etc.), cellulose, and other polymeric fibers; stabilized fibers of the foregoing materials; partially carbonized fibers of the foregoing materials (fibers that have been processed with low temperature carbonization); and others as are familiar in the art.

The present invention aims to replace the existing high temperature carbonization (HTC) furnaces in an industrial conversion line, but a low temperature carbonization (LTC) step is still required to produce carbon fiber with the desirable mechanical properties. However, Applicants have discovered that the invention is able to effect processing not only in the HTC regime, but also partway into the prior LTC regime. It is also contemplated that the present invention can perform some or all of the optional graphitization step. Two main differences between the invention and the technique currently used in the industry are its energy source and the configuration of the processing cavity. The invention uses energy from both electromagnetic (EM) i.e., microwave (MW) heating and radiant heating from a MW-absorbing susceptor located adjacent to the fiber tow to convert the material, with the electromagnetic power being dominant. By contrast, in current industry practice, conventional furnaces use radiative heating alone.

The invention establishes a new apparatus for modifying the bulk properties of polymeric materials, including polyacrylonitrile (PAN) fiber. The energy in use is a MW source that is delivered through a set of wave guides, combiners and tuners directly to the load. The load is composed of the fiber traveling through the resonant cavity and a susceptor (absorber) in a static position, facing the final waveguide connected on the opposite side of the traveling fiber. The concepts involved are:

1. Coupling the fiber with the propagating MW energy in a resonant cavity at elevated temperature
2. Setting the geometry of the system in order to absorb the transmitted MW energy not directly absorbed by the fibers by means of susceptors and re-radiating this energy as IR evenly across the width of the tow being processed.
3. Diverting the residual MW energy that would not be absorbed by the fiber nor by the susceptor back towards the fiber using the reflective walls of a resonant cavity A system has been built and tested that is capable of carbonizing a band of multiple tows of fiber material at atmospheric pressure with a shorter residence time (less than a minute) compared to conventional process (usually 75 seconds or more). This approach can potentially improve the energy consumption and product throughput under certain conditions.

A key concept of this invention and method relies on the dielectric properties of all materials involved. Coupling characteristics of the fiber is a function of its temperature and the frequency of the MW source. As noted in Applicants' co-pending applications, oxidized PAN fiber must be heated to around 250 °C before it becomes lossy enough to be heated efficiently by microwaves. However, partially carbonized PAN fiber being multiple orders of magnitude more conductive compared to oxidized PAN fiber requires a more elevated temperature before starting to couple with the MW energy.

The invention uses a configuration of waveguides, a combiner, stub tuner and final waveguide launcher that irradiates the fiber material. This creates a region of high field intensity on the passing band of multiple tows of partially carbonized PAN fiber.

Design Integration Overview

The concept of the invention is based on a single energy source (MW energy) yet implements two distinct heating mechanisms: 1) direct coupling of the fiber material with MW energy in a resonant cavity, and 2) absorption of excess MW energy by a susceptor that then provides further IR heating of the fiber material. The process is suitable for operation at atmospheric pressure. In most cases it is preferred to operate under conditions that are expected to produce a material that has the level of process of conventional carbon fiber so that the inventive process module may be inserted directly into an existing production line (refer to FIG. 1). That is, applicants prefer not to reach significantly higher temperatures for graphitization, in order to keep the final properties at those desired for industrial grade carbon fiber; however, the invention may, in some cases, have the potential to the reach a temperature range characteristic of the graphitization step. It is acknowledged in the literature that the configuration of the fiber production process as distinct steps between LTC, HTC and graphitization is preferred so that, among other benefits, the operator can apply different fiber tensions at these stages separately, and thereby generate a final product with optimal mechanical properties.

Note that for the HTC stage, as opposed to the LTC process in Applicants' co-ponding applications, several differences arise because the fiber after LTC contains very little remaining volatile matter. Therefore the need to deal with effluents and prevent condensation of tar and other unwanted materials on the cavity walls is substantially reduced. The present system therefore uses a much lower flow of sweep gas (typically nitrogen) to clear whatever volatiles are released during HTC and does not need supplemental heating of the cavity walls to prevent tar condensation.

The current example described here is designed to simultaneously treat an average of 200 k filaments which corresponds to 4 or more tows (50 k filaments each) of PAN-derived fibers that have already passed through the LTC process and are ready for HTC treatment. The system comprises several subsystems, the most important ones being the following:

1. a MW generator;
2. a transmission line system including a stub tuner just upstream from the MW launch structure;
3. an applicator 20 with a central resonant cavity 21, having two internal adjustable plates and two end sections to accommodate the movable walls and their adjusting hardware and help reduce stray MW energy and prevent emission, one on either end where the fiber material enters and then exits the resonant cavity; and,
4. a control system (in this case operating in a LabVIEW programming environment) that is used to centralize the control of the generator and the fiber handling system, monitor the temperatures, and ensure a safe operation. Note this system is not necessary for operation of the present invention and is considered an ancillary system.

Other ancillary subsystems, familiar in the industry, may include the following:

1. a chilled water-cooling system;
2. a nitrogen purge system with multiple ports;
3. a fiber handling system with its ancillary equipment; and,
4. a gas exhaust system.

Figure 2:
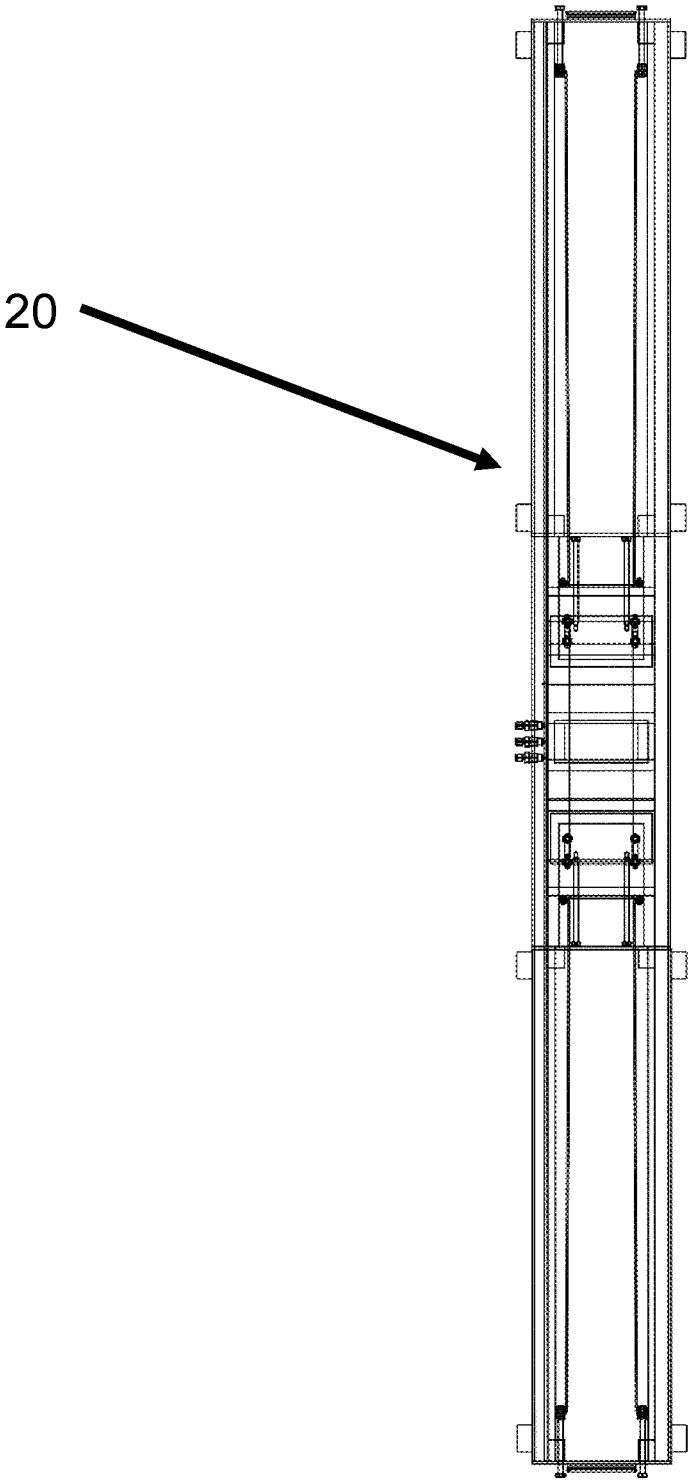
FIG. 2 presents a top view of an applicator in accordance with some aspects of the invention.
Figure 3:
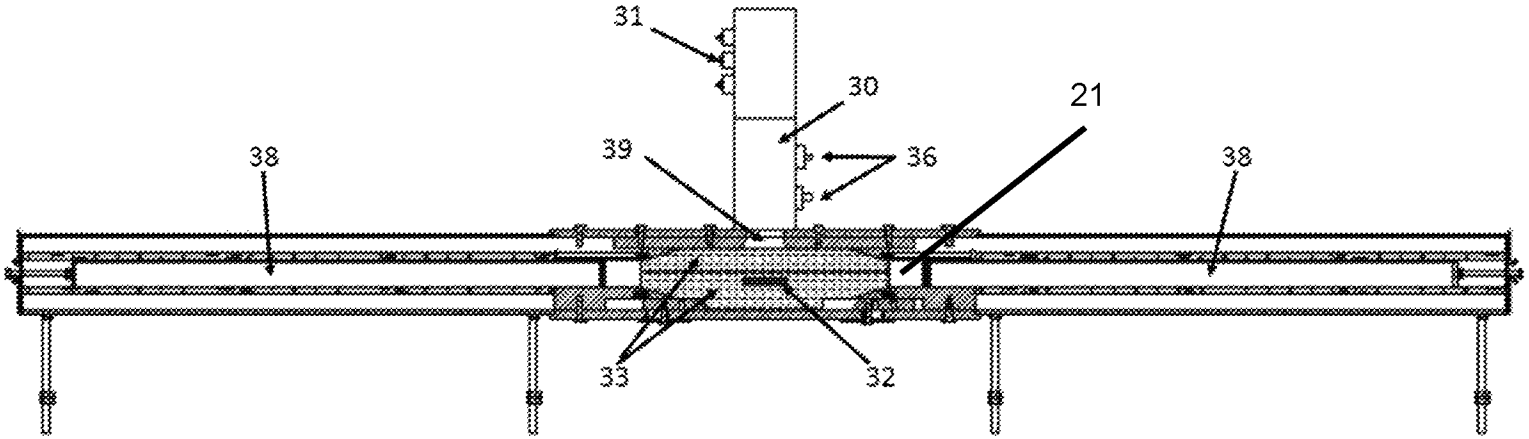
FIG. 3 presents a side view in cross section of an applicator in accordance with some aspects of the invention.
Figure 4:
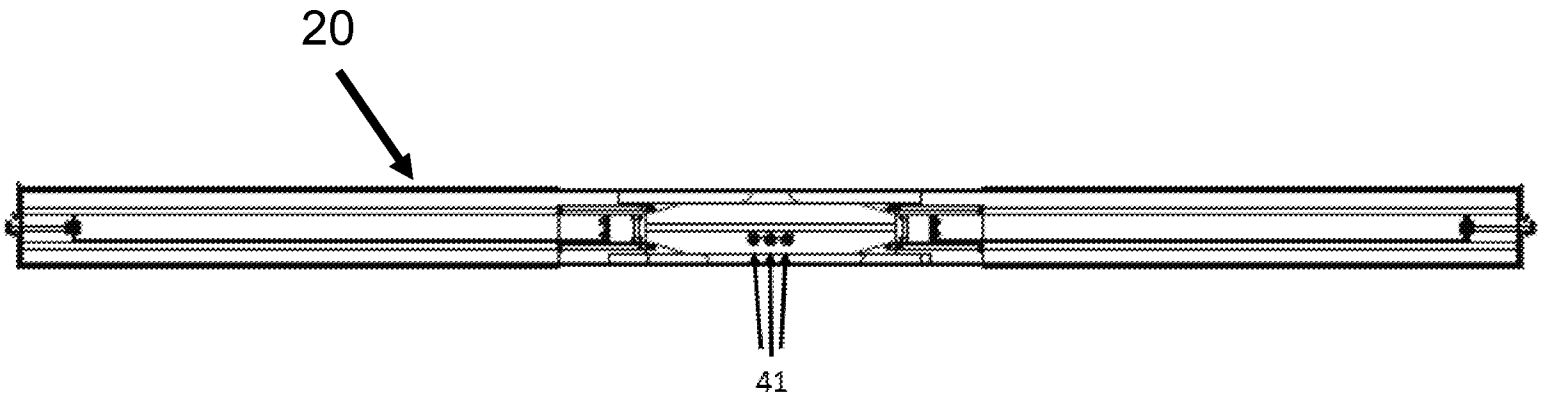
FIG. 4 presents a side view in cross section of an applicator in accordance with some aspects of the invention. The fiber tows pass horizontally through the center of the applicator.
Figure 5:
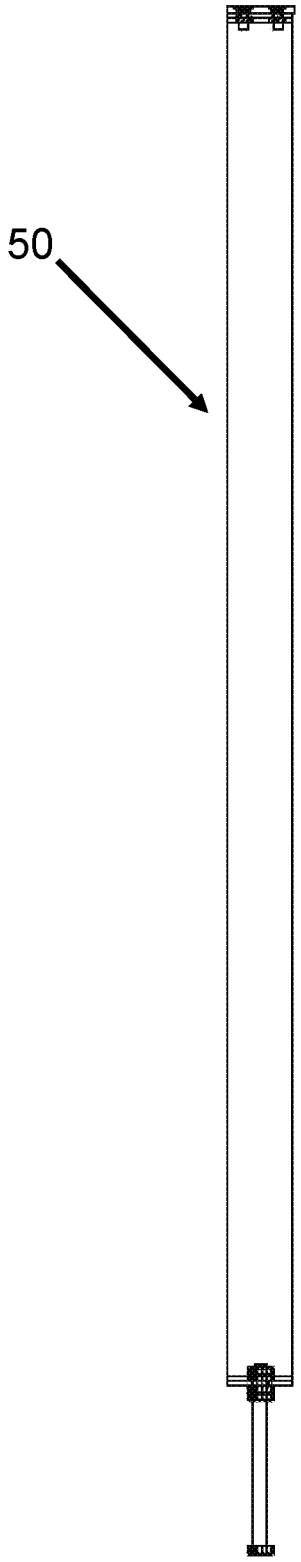
FIG. 5 presents a side view of an internal tuning structure that is present on either side of the resonant cavity in accordance with some aspects of the invention.
Figure 6:
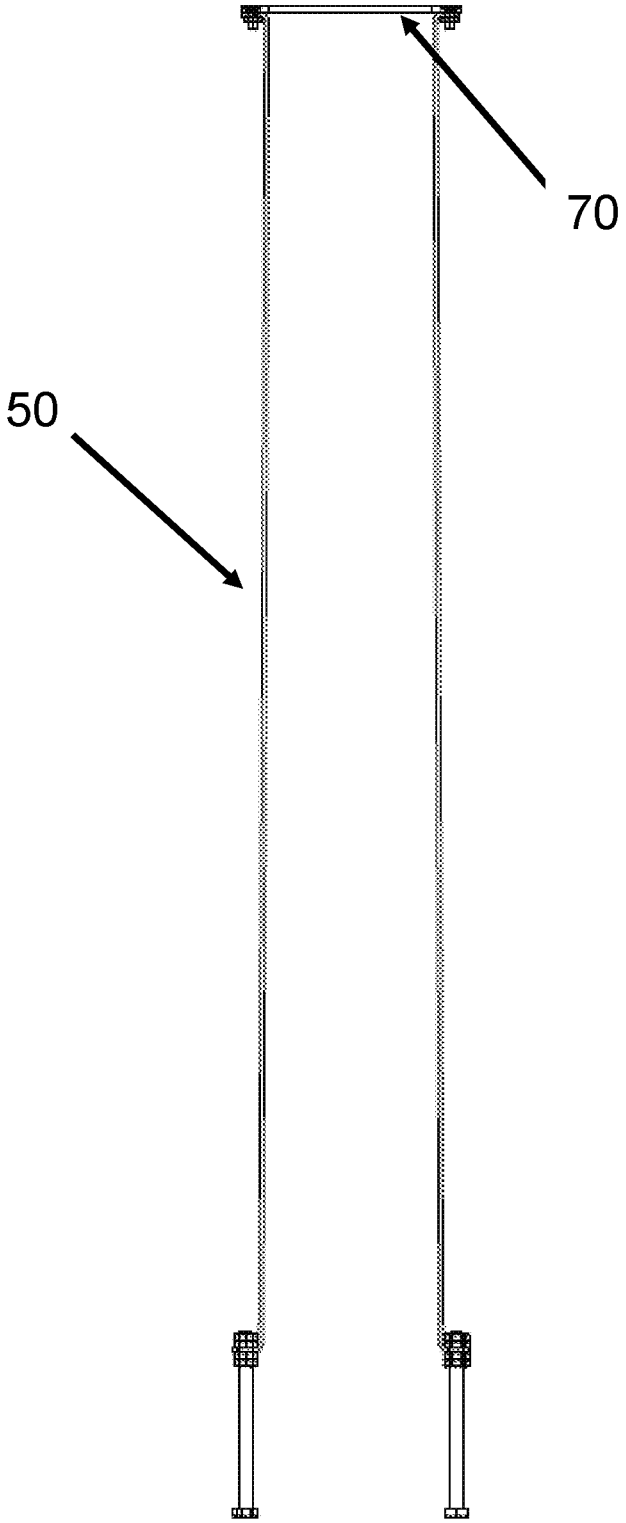
FIG. 6 presents a top view of an internal tuning structure that is present on either side of the resonant cavity in accordance with some aspects of the invention.
Figure 7:
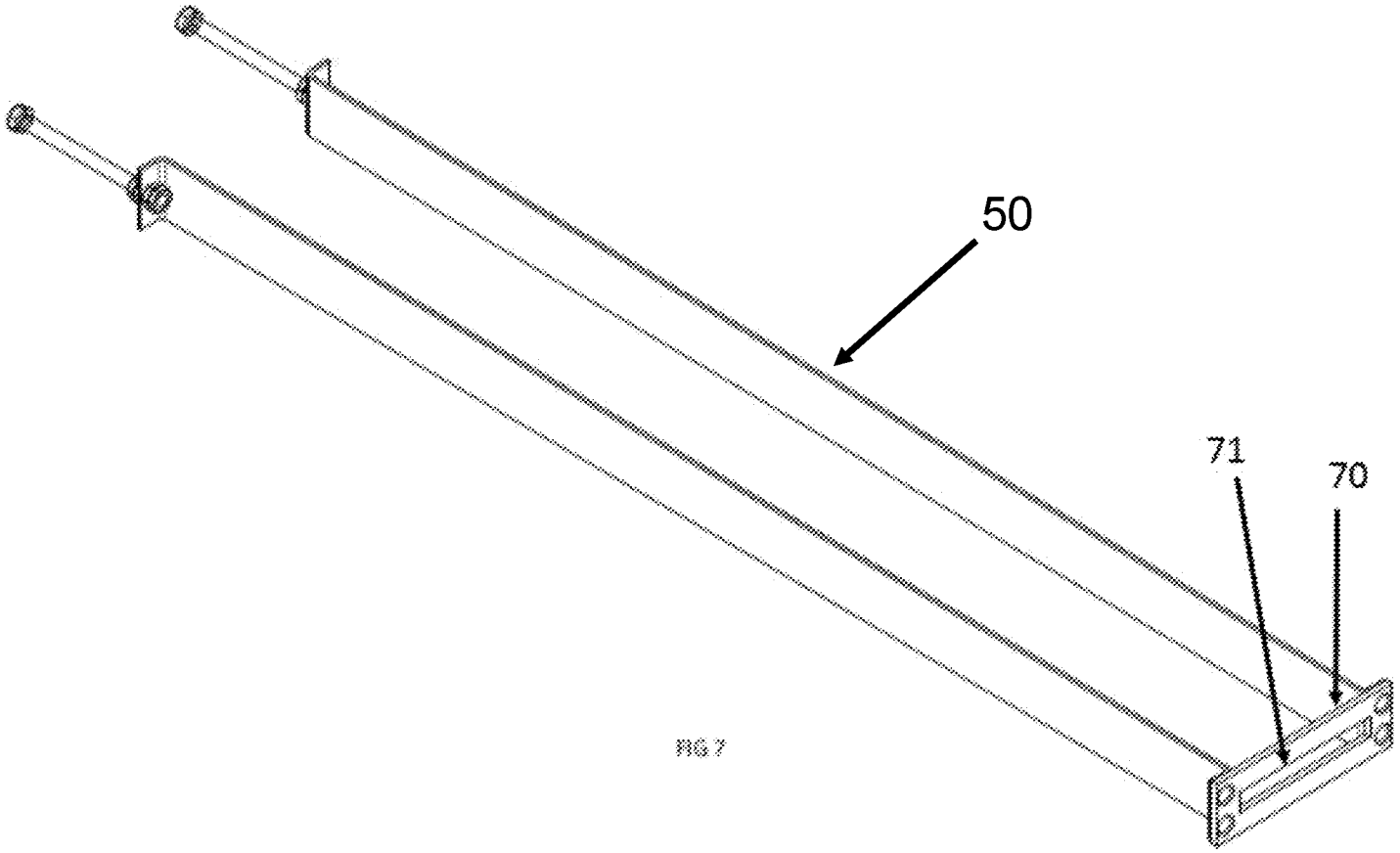
FIG. 7 presents an oblique view of one of two internal tuning structures that are present on either side of the resonant cavity in accordance with some aspects of the invention.
Figure 8:
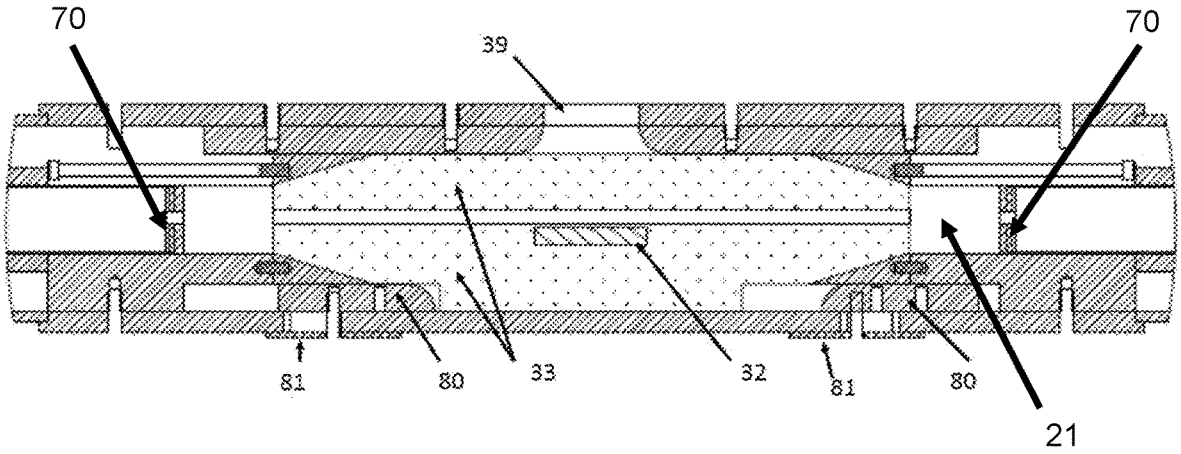
FIG. 8 presents a side view in cross section of a furnace section showing a susceptor plate supported by insulating blocks in accordance with some aspects of the invention.
Figure 9:
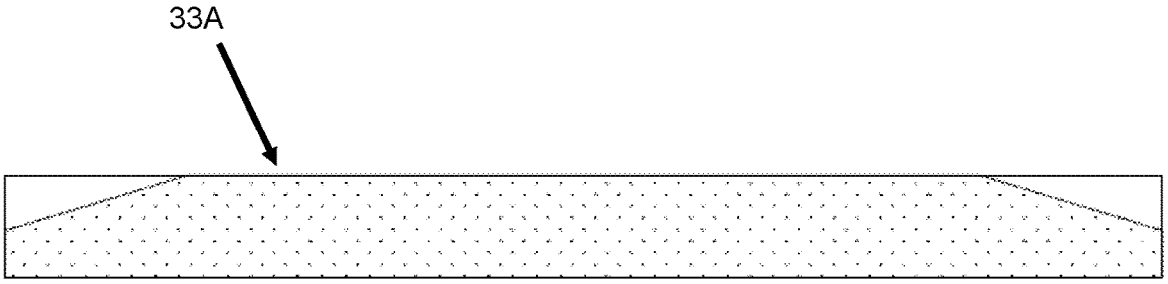
FIG. 9 presents a side view of a top insulating block in cross section in accordance with some aspects of the invention.
Figure 10:
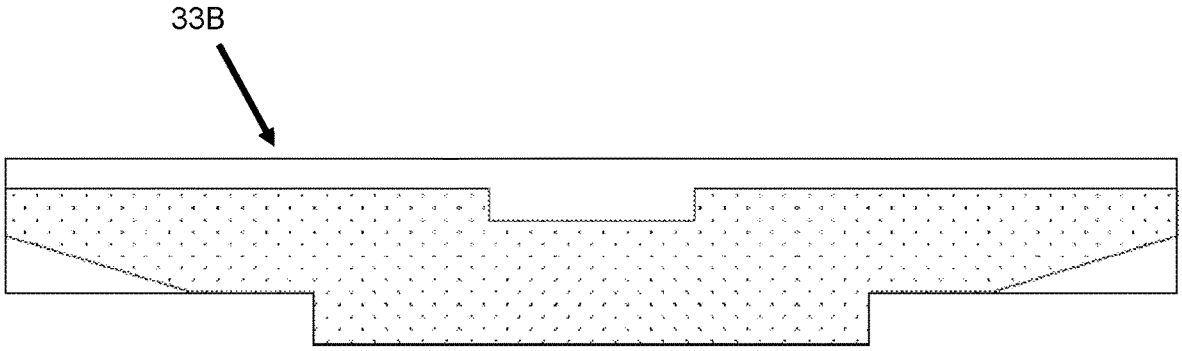
FIG. 10 presents a side view of a bottom insulating block in cross section in accordance with some aspects of the invention.

The applicator 20 comprises a single elongated cavity 21, FIGS. 2-4. The cross section of the volume is typically rectangular, and its dimensions remain consistent from one end of the applicator to the other. The length of the cavity is set by two movable walls 70, FIGS. 5-7, one at each end, to allow for tuning to improve efficiency. Each of these movable walls includes a slot 71 (FIG. 7) through which the fiber tow passes during processing. MW power is supplied by a waveguide launcher 30 through aperture 39, and radiant heat is supplied by a susceptor plate 32 facing the launcher as the fiber tow passes in between the launch and susceptor. The temperature of susceptor 32 may be measured by thermocouples 41 or by non-contacting means as are known in the art. Microwave transparent insulating material 33 is preferably placed in the cavity and supports the susceptor plate 32. The insulating material 33 is preferably fabricated in two halves, an upper half 33A and a lower half 33B (FIGS. 9-10). Extending from the cavity at each end are elongated sections of the same cross section; these house the adjustment mechanisms for the movable end walls and also serve as part of a microwave choke system to minimize leakage. While some parts of the applicator may be warmed to prevent condensation of volatile species (e.g., the processing cavity walls and the chokes), others may need to be cooled (e.g., the adaptors with their connectors, and the parts of waveguides on which they are attached). As used herein, "applicator" refers to the overall device 20 that receives microwave energy and through which the fiber passes for treatment. "Applicator cavity" refers specifically to the internal space 21 in which microwave energy exists; it is bounded by upper and lower walls, side walls, and the movable end walls 70 thereby forming a tunable microwave applicator cavity. As shown in FIG. 8, the applicator cavity is partially filled with susceptor 32 and insulating material 33.

Description of the Subsystems

Example

The Generator and the Transmission Line

In this work, Applicants used a solid-state generator (Model PTS Precision Power manufactured by Cellencor, Inc., Ankeny, IA), with an operating frequency range of 2.4 to 2.5 GHZ, which is in an ISM band. This power supply was selected for the following reasons:

1. High accuracy and the narrow bandwidth of operation of this type of generator is particularly beneficial for this process that shows strong variations of $S_{1,1}$ and narrow favorable bands of operation. Solid-state generators typically have the capacity to select a band of frequencies with a return loss as low as −20 db, or better.
2. It is possible to operate multiple ports (up to four ports in the present case), with individual control of the power (up to 1 kW), phase angle, and frequency of operation. The four ports can be phase synchronized for use with a combiner.
3. Reliability: the life expectancy of magnetrons can be substantially affected by the operating conditions, and rarely exceed one year under continuous operation. Furthermore, the life expectancy of a magnetron can be shortened by random failure. On the other side, the newer solid-state technology shows higher reliability with 10× longer life expectancy. This type of device is more adapted for continuous production.

The transmission line is the subsystem that connects the generator to the applicator. In the current case, high power cables are used to connect each port of the generator to a coax-to-waveguide combiner fastened at the input end of the waveguide structure as previously described. A circulator is not needed because the generator is capable of measuring $S_{1,1}$ and tripping when the reflection exceeds a safety limit. These high-power cables were individually a tested and, as-received, had transmissibility of around 98%.

It will be appreciated that many other configurations are possible for the construction of the transmission line using routine engineering principles. Ideally, a full solid waveguide solution is preferable. The choice of the transmission line is mostly driven by the following considerations:

1. Impedance and insertion loss of each element.
2. Power rating at the frequency band of interest.
3. Management of the reflected power using appropriate equipment, such as circulators, dummy loads, or other familiar components.
4. Thermal characteristics of any hardware that might be connected to components that will get hot during operation.

In the setup disclosed herein, the transmission line is not in direct contact with hot parts: they are safeguarded by a liquid cooling system that prevents the adaptors and the connectors from melting.

The waveguide is made from off-the-shelf components. For the current embodiment these include a reflectometer 30 mounted directly to the single opening 39 of the applicator as indicated in FIG. 3. The reflectometer includes a power coupler for forward and reflected power sensors 36 to aid in tuning. Above the reflectometer a stub tuner 31 is mounted. In this example, the reflectometer is a Mega Industries Model WR340 0G9Y7 directional coupler, the stub tuner is a Muegge Model MW2009A-260ED, and the power meter is a Keysight Model E4417A. Above the stub tuner a four-port combiner is mounted (not shown). This combiner has four coaxial connections as inputs and a single waveguide as an output. The combiner is used because the particular MW power supply used for the current embodiment consists of four 1 kW amplifiers, each with its own coaxial output.

Example

The Applicator

One suitable applicator is a rectangular prism offering a single volume with inner dimension 3×1×67 inches.

Figure 11:
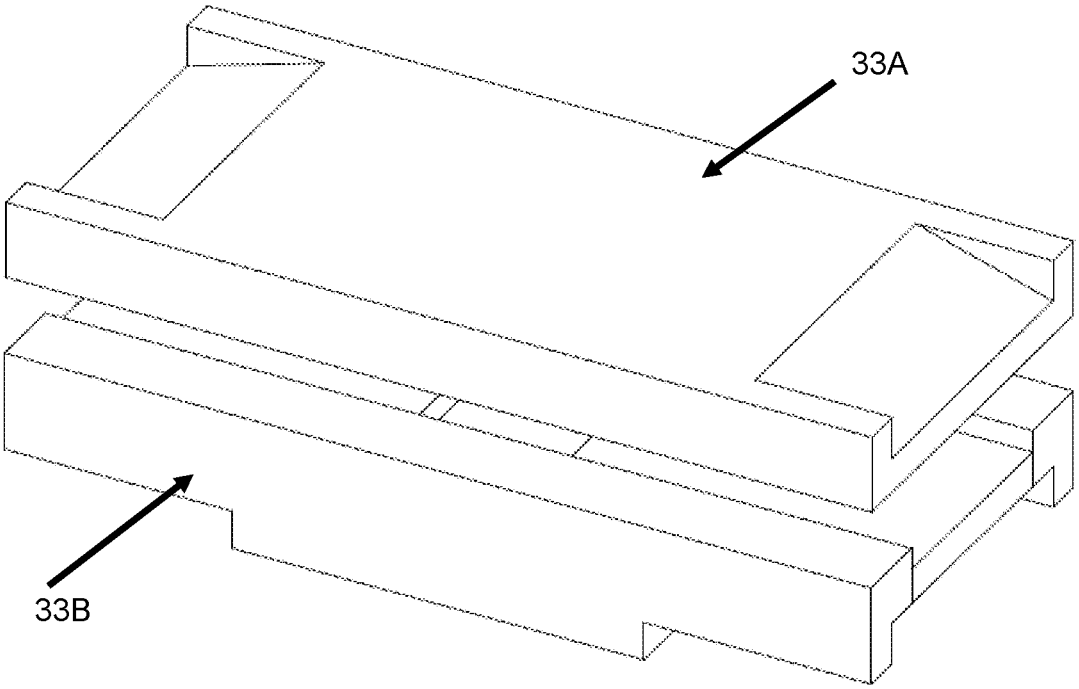
FIG. 11 presents a perspective view of the top and bottom insulating block sections aligned in accordance with some aspects of the invention.

The central zone of the applicator, shown in FIG. 8, is where the processing occurs. It contains a stainless steel shell designed through computer modeling to create a resonant cavity at the frequency of operation of the MW energy. A two-piece insert 33 made of microwave transparent high temperature material that is a close fit with the cross section of the cavity is shown generally in FIGS. 9-11. The insulation insert, if used, may be 11-12 inches long. It also maintains the susceptor 32 in fixed position, FIG. 8, and protects the waveguides from heat and contamination. The susceptor 32 is affixed to the insulation block 33 by a locking system similar to a groove-tongue configuration. The insulation can conveniently extracted when a top stainless steel plate is removed, e.g., when maintenance is needed.

As shown in FIG. 8, the wall of the applicator facing the MW launcher may further be provided with sliding plates 80 secured with guide pins 81 that can move in slots to further adjust the cavity characteristics. For clarity, FIG. 8 shows the left-hand plate slid toward the launch point and the right-hand plate slid away from the launch point. These sliding plates, when present, may be adjusted along with the sliding end walls, preferably during the low-power tuning stage of the process.

Example

The Susceptor

The susceptor 32 is a block made of one or more lossy materials, preferably with heat conducting or spreading features in the volume or on the face that is not directly exposed to the EM energy (preferably the back side, the one that is opposite to the wave guide). The choice of the lossy materials is based on the value of the permittivity over the frequency band and temperature of interest. Applicants prefer a material with tan δ of at least 0.04 and more preferably, at least 0.06. For the current example, Applicants chose nitride bonded silicon carbide (SiC) for its cost and availability, but other materials could be selected provided that their structural properties, loss factor, and thermal conductivity are acceptable at the temperature range of interest. The shape of the block can be a tile, or any other shape. Applicants prefer rectangular prismatic tiles for their simplicity and easy scalability. Hence this particular shape is the one that was evaluated in Applicants' test program. The tile is preferably oriented crosswise relative to the propagation of the fiber, and as close as possible to the fiber tow.

For this application, SiC based ceramics are particularly interesting because they are among the ceramics with the highest theoretical heat conduction, approaching the 200 W/m·K of aluminum. This property is highly desirable because it prevents hot spots and sharp thermal gradients and thermal treatment discrepancies across the width of the fiber tow. However, the selection of this particular ceramic is not straight forward. In addition to having more than 200 crystalline forms, a large variety of SiC is available on the market. Each product on the market is different because of the manufacturing process, grain size and composition. Consequently, a large variation of the material and its properties, including thermal conductivity and dissipation factor can be found. As a result, a given SiC may not reach theoretical expectation. Some materials could offer half or less of the expected thermal conductivity. Furthermore, reported properties are usually lower at high temperature. Like most ceramics and metals, SiC-based materials' thermal conductivity typically drops around 40% to 50% towards the upper end of its service temperature rating, increasing the risk of temperature non-uniformity by a comparable factor. In any case, the skilled artisan can determine suitable materials and dimensions for a particular application through routine experimentation. For example, a suitable volumetric fraction of SiC could be dispersed in a thermally conductive ceramic matrix such as BeO, hexagonal BN or AlN to provide a combination of high dielectric loss and high thermal conductivity.

Given the above considerations, the susceptor material should be selected and designed based on the following criteria:

1. The selection of material of construction with high thermal conductivity and high loss factor is preferred. The selected material should also be stable at high temperature, in oxidative and non-oxidative environments. Some ceramics can satisfy those three specifications, but carbonaceous materials, such as graphite, might offer substantially higher thermal conductivity. However, carbonaceous materials might not be isotropic and might be unstable in an oxidative environment, bringing a risk of degradation of the hardware in a hot oxidative environment (in the case of accidental discontinuation of the purge of inert gas). Because of its anisotropy and its instability at high temperature in an oxidative environment, carbonaceous materials might be disqualified in favor of ceramics, especially SiC-based ceramics for this type of application at larger scale.
2. The insertion of a heat spreading structure added to the blocks of the lossy ceramic as taught generally in Applicants' co-pending U.S. patent application Ser. No. 17/902,818 (see FIG. 15 therein) may increase its thermal conductivity. Grooves, bore-through holes, or other geometrical designs filled with a material having a high thermal conductivity can be used for this purpose. In one design discussed in '818, copper is added on one side of the ceramic for the LTC system. However, the use of copper in the construction of the susceptor will limit its operating temperature to ~1050 °C. This temperature limitation would prevent such an arrangement from operating in the temperature range of operation for HTC which may exceed 1600 °C. Thus, for HTC processing, thermally conductive ceramics would be preferred over copper as a heat distribution means.
3. Applicants have found that it is preferable to place insulation 33 around the susceptor to mitigate the heat loss through the covered surfaces. Insulation helps to maintain a more a homogeneous temperature across the volume and the side of the susceptor facing the fiber to be treated. In various tests, Applicants have found that there is normally some temperature variation across a susceptor plate, e.g., 100 °C or more when the average plate temperature might be in the 500-600 °C range. Similar variation can be observed when operating in the 1200-1300 °C range. Note that this is due in part to the particular SiC used; other types of SiC will have their own characteristic thermal properties.

It will be appreciated that the invention may employ a single waveguide and susceptor plate, particularly for sample batches or laboratory research. For larger scale processing it may be helpful to employ waveguides in an array configuration to cover large processing widths.

Example

Fabrication of the Cavity

Applicants chose stainless steel for its machinability, knowing the temperature of the walls of the cavity would not exceed 1000 °C. Other high temperature alloys might be preferable for some parts such as the waveguide system.

The main volume is a flat horizontal rectangular elongated tunnel. For the construction, two parallel machined bars (or "side rails") going from end to end of the volume constitute the main structure of the assembly. These preferably have grooves to receive copper gaskets at all seam/joint locations with other parts as taught generally in Applicants' co-pending U.S. patent application Ser. No. 17/902,818 (see FIG. 11 therein) to prevent EM radiation leakage. Rectangular plate or waveguide stands are bolted along these two rails, forming a rectangular channel.

Example

The Dampers

The overall length of the rectangular tunnel defined by the side rails is typically 67 inches, of which the actual processing cavity is only about 11-12 inches long. The remaining length is evenly split into two damper sections, one damper at the entrance of the process and the second at the exit. They are designed to dissipate the MW energy that escapes the central processing zone, thereby acting as microwave chokes to minimize MW emissions to the outside. These dampers make the system safe and potentially operational outside of the ISM band.

The dampers are built as follows:

1. They are straight extensions of the processing cavity (same cross section). Their frame is shared with the processing zone by using the side rails as their main structure. They are closed with large plates made of stainless steel on the top and bottom.
2. They are lined with nitride bonded SiC tiles 38 of 2 mm to 15 mm thickness along the top, bottom, and side walls.
3. No additional heaters are required but may be used to prevent buildup of condensed off-gas from the processed material.

Concept of the Applicator

The concept of this applicator is to expose the fiber, at atmospheric pressure, directly to the MW energy in a resonant cavity and then absorb and re-radiate energy that was not absorbed by the first pass through the fiber tow, using a high-loss susceptor plate placed on the opposite side of the fiber tow and facing the waveguide opening. The susceptor has several functions:

1. Elevating the temperature of the fiber to enhance MW coupling.
2. Limiting the propagation of the non-coupled energy along the cavity. This partly mitigates the emission of MW energy from the slots where the fiber tow enters and exits the system.
3. Spreading the heat across the width of the process cavity, for better process homogeneity.

Example

Tuning of the System

As in any MW operating system, the tuning of the system is a critical aspect that must be satisfied. In the present invention, tuning is preferably a two-stage process, FIG. 12. The cavity is assembled and carbon fiber tow is passed through the center of the insulating structure and supported so that it is suspended between the MW launch structure and the susceptor plate. The cavity is closed and ready for operation. Then, using a vector network analyzer at low MW power (typically 1 μW signal) the movable walls 70 on the two ends of the cavity are adjusted mechanically to achieve a coarsely tuned state. Once the system is brought up to full power, fine tuning is done using the stub tuner 31 and the power meter to minimize MW power reflected from the applicator back into the waveguide.

Figure 12:
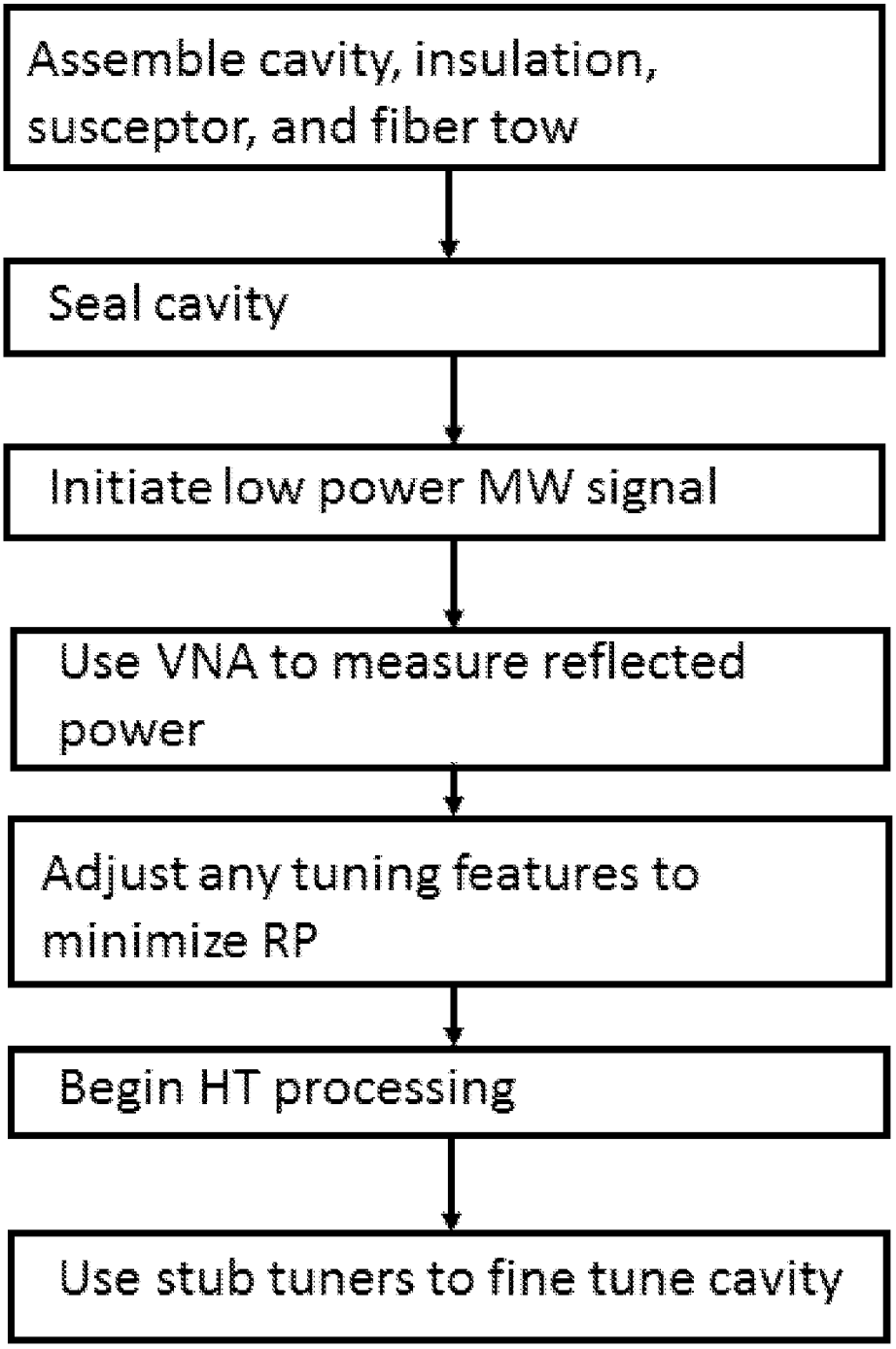
FIG. 12 presents a series of process steps in accordance with some aspects of the invention.

It will be appreciated that some of the steps shown in FIG. 12 may be used only in the initial setup of the system or when changing the product from one type of fiber to another. The adjustment of the sliding walls 71 would generally not be needed when simply changing from one batch of tow to another of the same type. In that case, periodic adjustment of the stub tuner would generally be all that is needed to maintain good coupling to the applicator cavity.

Pattern of Radiation

Because the fiber tow and susceptor lie in a resonant cavity, defined by the fixed and movable walls, in this example the pattern of radiation is confined to a region about 11 inches long and 3 inches wide.

Fiber Delivery

It is important to have a fiber handling system able to deliver multiple tows of fiber with a good spread and under a controlled tension and trajectory. The tow band in the cavity must travel through the region of high MW field intensity. Furthermore, the fiber must propagate between the launcher and the susceptor, preferably leaving less than 5 mm above and below the tows with the current geometry, while avoiding direct contact between the moving fiber tows and the susceptor plate. Fiber handling systems are well known in the art of carbon fiber manufacturing, and the skilled artisan can readily adapt such systems and principles to particular process configurations. It will be understood that the thickness of the fiber tow itself will depend on the type of fibers, the diameter and number of fibers in the tow, and how effectively the tow is spread laterally as it passes into the system. To avoid any contact between the fiber tow and the fixed components, Applicants prefer that the gap between the waveguide opening and the susceptor plate be a minimum of 2 mm and preferably 5-10 mm. To maintain resonant cavity conditions, Applicants contemplate that the maximum gap between waveguide and susceptor should be kept to less than the wavelength of the MW energy being used, and more preferably less than one-half the instant wavelength.

Processing Experiments and Results

This section presents a series of results obtained with the exemplary system previously described and illustrated. All testing was completed with equipment designed to operate in an ISM band (2.4 to 2.5 GHZ). The results may vary with the dimension of the equipment and its frequency of operation; the skilled artisan will appreciate that the physical dimensions of most microwave or RF components will scale with frequency in a well-understood way. For simplicity, the present invention was restricted to this band of operation in the following examples, but the overall inventive principle is not limited to any particular frequency.

The following examples are based on the continuous processing of feedstock consisting of multiple 50 k filament tows of industrial grade oxidized fiber PAN with a density of 1.37 g/cm$^3$, that was subsequently processed at the LTC stage. This feedstock material is referred to as LT fiber. This LT fiber is subjected to heating in an inert atmosphere to become fully carbonized fiber (carbon fiber) using the present invention. Three examples referencing Tables 1-3 show physical and mechanical properties of the resulting fully carbonized fiber.

All processing was done in an inert, i.e., nonreactive and non-oxidizing, atmosphere, in this case nitrogen. It will be understood that other inert gases will also be suitable, and that industrial gases are never completely free of impurities. The carbon fiber industry generally recognizes that a gas may be regarded as non-oxidizing if the oxygen content is less than about 50 ppm. A supply of nitrogen was used that met this standard.

As a reference, LT fiber typically has a density of 1.5-1.6 g/cm$^3$. After exiting the HTC process, the fiber typically has a density around 1.7-1.8 g/cm$^3$. It is generally recognized that higher density usually correlates with higher modulus, but not necessarily with higher tensile strength.

Example

In this example, Table 1 presents data where two 50 k tows were simultaneously processed. Only continuous processing was considered. A density equal or greater than 1.74 g/cm$^3$ with 3.6 kW of MW power was achieved with residence times shown. Four tows coming out of the HTC process are continuous samples of pristine (damage free) material. Table 1 shows mechanical properties after full carbonization with the present invention.

TABLE 1

Top four mechanical results from Set 1

| No. | Residence time, s | Diameter, μm | Break stress, ksi | Modulus, Msi | Density, g/cm$^3$ |
|---|---|---|---|---|---|
| 1 | 22.50 | 6.5 | 596 | 30.8 | 1.74 |
| 2 | 33.75 | 6.8 | 569 | 31.5 | 1.76 |
| 3 | 96.43 | 6.8 | 537 | 33.1 | 1.76 |
| 4 | 16.88 | 6.9 | 515 | 29.3 | 1.78 |

Example

In this example, Table 2 presents data where four 50 k tows were simultaneously processed, and shows mechanical properties after full carbonization with the present invention. Only continuous processing was considered. A density equal or greater than 1.84 g/cm$^3$ with 2 KW of MW power was achieved with residence times shown. Four tows coming out of the HTC process are continuous samples of pristine (visually damage free) material, however the results of this particular dataset were suboptimal. First, above average densities (>1.8 g/cm$^3$) were obtained, indicating over-processing of the material. Second, the mechanical properties of break stress and modulus were not ideal. Finally, the electrical resistivity was too high (>$2\times10^{-3}$ Ω-cm). Electrical resistivity of carbon fiber is one measurement that gives insight into the general morphology of the sample. Carbon fiber should have good electrical conductivity, which means a low electrical resistivity. Sample 1 had minimal acceptable properties, but the remaining two samples had unacceptably low mechanical properties and high electrical resistivity. The combination of fiber tension, line speed and electromagnetic energy deposition parameters were explored.

TABLE 2

Top three results from Set 2.

| No. | Residence time, s | Break stress, ksi | Modulus, Msi | Density, g/cm$^3$ | Electrical resistivity, Ω-cm |
|---|---|---|---|---|---|
| 1 | 33.75 | 528 | 28.9 | 1.87 | 0.00433 |
| 2 | 33.75 | 443 | 25.2 | 1.94 | 0.01479 |
| 3 | 22.5 | 323 | 18.3 | 1.84 | 0.28459 |

Example

In this example, Table 3 presents data where four 50 k tows were simultaneously processed. Only continuous processing was considered. A density equal or greater than 1.79 g/cm$^3$ with an input of 2 KW of MW power was achieved with residence times shown. Four tows coming out of the HTC process are continuous samples of pristine (damage free) material. Table 3 shows mechanical properties after full carbonization with the present invention. After general evaluation, electrical resistivity was in the range of $1.6\times10^{-3}$ to $2\times10^{-3}$ Ω-cm, which is in the acceptable range.

Top three mechanical results from Set 3

| No. | Residence time, s | Diameter, μm | Break stress, ksi | Modulus, Msi | Density, g/cm$^3$ |
|---|---|---|---|---|---|
| 1 | 33.75 | 6.56 | 642 | 31.5 | 1.79 |
| 2 | 33.75 | 6.68 | 586 | 30.5 | 1.78 |
| 3 | 33.75 | 6.75 | 556 | 31.7 | 1.79 |

To reach the expected level of processing in less than a minute, the susceptor must reach a temperature in the 1000-1600 °C range, which is the typical range of HTC conventional process. This indicates:

1. In the inventive process, IR radiated from the susceptor plays an important role in the process.
2. At equivalent residence time and temperature, the inventive process provides a material with a density substantially higher than a conventional process.

Those two observations indicate the dual characteristic of this process: both direct MW coupling to the fiber tow and temperature elevation via IR heating by the susceptor contribute to the process of carbonization of the material.

In addition to the foregoing specific examples, the skilled artisan will readily appreciate that many modifications and variations of the invention may be contemplated within the scope of the invention as claimed.

The MW energy may be provided by any suitable power source, which may include: magnetrons, klystrons, gyrotrons, traveling wave tubes, and solid state power amplifiers. The power supply may operate at any suitable frequency; when operating at frequencies outside of the recognized ISM bands, RF chokes or dampers may be installed on the end slits to reduce electromagnetic emissions to comply with communications regulations.

Many suitable solid state power supplies are commercially available. Some examples include: model PTS-8 (Cellencor, Inc., Ankeny, IA); model GMS-200 (Sairem, 69150 Décines-charpieu, France); model RIU256K0-40T (RFHIC Corporation, Republic of Korea); model MR1000D-200ML (Gerling Applied Engineering, Inc., Modesto, CA); and others.

Those skilled in the art will appreciate that all dimensions given herein are simply illustrative of one working system designed for operation at 2.45 GHZ, and are therefore non-limiting, as the invention may be adapted to use a power supply operating on another frequency, in which case many physical dimensions will be adjusted accordingly.

The applicator cavity may be constructed from any suitable metal alloys by any convenient fabrication processes as are well known in the art. Although it is preferred that symmetrical geometry is maintained, and so in the exemplary applicator both end walls are movable, in some circumstances, adequate rough tuning may be achieved with only one movable end wall or asymmetric adjustment. Nonmetallic components may be fabricated from any suitable insulating material having appropriate dielectric properties such as glass, glass-ceramics, ceramic composites, and machinable glass-ceramics.

The carbon fiber precursor material may be cellulose, pitch-based fibers including isotropic and mesophase pitch, rayon, polyacrylonitrile (PAN), nylon-based fibers, and others and may be subjected to conventional pretreatments, including pre-stretching, and stabilization in an oxidizing environment at 200-400 °C for ninety minutes to several hours depending on the type of precursor used. After carbonization in the MW process described in the various examples, the carbon fiber may be subjected to further process steps that may include: graphitization treatment typically between 2000 and 3000 °C; surface treatment in an electrolytic or acidic bath; and coating with a sizing material.

The HTC apparatus and its associated power supply forms a process module intended to replace the conventional radiant heated high temperature carbonization stage in a continuous carbon fiber production line. It is therefore necessary for the fiber tow to move through this process stage at the same speed as it moves through the production line generally. The skilled artisan will appreciate that by routine experimentation and engineering, the variables of chamber temperature, microwave power, and the physical dimensions of the cavity may be adjusted so that the prevailing speed of the fiber tow will allow adequate residence time in the applicator cavity, and that the amount of stretch applied to the fiber in this module might be different from that applied during the conventional HTC process. Furthermore, Applicants' experimental results suggest that the invention performs HTC more effectively than the conventional process.

The temperature of the susceptor blocks may be measured by any suitable means as are well known in the art, including thermocouples 41, resistive temperature devices, fiber optic probes, IR detectors, etc.

The control system may rely on any suitable control strategies, including following a preprogrammed process recipe, or using feedback control based on inputs provided by a user or by various process sensors such as temperature and reflected power. The process control system may have the capability to adjust MW power, MW frequency, gas flow, tow speed, and other variables. System tuning has been manually adjusted prior to a particular run, but it will be understood that actuators could be added, as are well known in the art, so that the control system could adjust the tuning component positions in real time based on process data.

The susceptor plate may be constructed of any suitable material having appropriate dielectric loss at the frequencies of interest. It may be homogeneous or it may be a composite body containing, e.g., thermally conductive elements at the temperature range of interest to spread the temperature more evenly across the plate. It may further be functionally graded so that the dielectric loss is greater in areas where the impinging MW power is weaker, and lower in areas where the impinging MW power is stronger.

The insulating materials that hold the susceptor in place may be any suitable ceramic material, including alumina, silica, mullite, zirconia, zircon, fiberglass, and mixtures thereof.

The gas mixture that is used to create an inert environment can be injected into the HTC device at room temperature. This gas mixture may or may not be preheated because it is not necessary to heat the incoming fiber material for it to be able to couple effectively with the MW energy.

It will be appreciated that in the art of carbon fiber manufacturing, while in most cases continuous tows are used, there are many applications in which fibers are processed as nonwoven mats of material, but still in a continuous fashion (i.e., roll to roll). This is common with making carbon fiber from pitch (a derivative of either oil or coal). In this instance, pitch is spun, chopped and developed into a rolled nonwoven mat. No tension is applied to the mat during conversion, as it would not support it. Therefore the mat must be supported by a driven conveyor belt in every stage of conversion processing (oxidation, carbonization, surface treatment, etc.).

Applicants therefore contemplate that the invention mat be modified to process a continuous nonwoven mat as described follows.

Example

The arrangement as shown generally in FIG. 4 would be modified (in particular, the height extended) to allow for a driven conveyor belt to extend from the outside of the entrance on the left of the apparatus up to the location of the susceptor that lies directly under the radiator. A second conveyor belt would then begin again on the other side of the susceptor and extend out to the outside of the exit of the applicator on the right. The belt would preferably be made of material suitable for elevated temperatures, but it would not be necessary to use a material that can survive the treatment temperature seen directly between the radiator and the susceptor (typically between 1200-1600 °C). The nonwoven mat would therefore be transported through the full length of the applicator by the two driven conveyor belts at synchronous speeds. When first feeding the material through such an arrangement, a tool may be used to "help" the leading edge of the nonwoven mat across the stationary susceptor plate. But once the nonwoven mat is securely carried on both on both sides of the conveyer belt system, it would span the gap between conveyors in the vicinity of the susceptor.

Example

In situations where it would be undesirable for the nonwoven mat to drag across the hot susceptor, the system may be inverted, i.e., the MW launch may be placed on the bottom of the cavity and the susceptor placed above the mat, facing downward. In this configuration, the mat may be supported, if desired, by a rigid, MW-transparent material that spans the gap between the inlet and outlet conveyor belts.

The invention claimed is:

1. An apparatus for carbonization of fiber materials comprising:

a power supply and transmission line to provide a source of electromagnetic energy of a selected power and frequency into a waveguide;

an applicator cavity having an inlet opening and an outlet opening allowing a continuous fiber material to pass therethrough, and further comprising:

at least one open waveguide launcher operable to deliver the electromagnetic energy from the transmission line into the cavity;

a body of susceptor material facing the open waveguide launcher and spaced apart therefrom to form a gap through which the continuous fiber material passes so that the fiber material is simultaneously exposed to electromagnetic energy from the open waveguide launcher and to radiant thermal energy from the susceptor body;

at least one movable wall whereby the length of the cavity may be adjusted for efficient tuning; and, at least one temperature measuring device proximate to the susceptor body.

2. The apparatus of claim 1 wherein said power supply is selected from the group consisting of: magnetrons, klystrons, gyrotrons, traveling wave tubes, and solid state power amplifiers.

3. The apparatus of claim 1 wherein said transmission line comprises a waveguide, a stub tuner, and a power coupler equipped for simultaneous measurement of forward and reverse power levels.

4. The apparatus of claim 1 wherein said susceptor material comprises a material having a tan δ of at least 0.04 over a useful operating temperature range of 1000 to 1600 °C.

5. The apparatus of claim 4 wherein said material is selected from the group consisting of: silicon carbide, silicon nitride, BeO, hexagonal BN, AlN, and mixtures, composites, and alloys thereof.

6. The apparatus of claim 1 wherein said cavity has two independently movable walls, one on each end, and each of said movable walls includes an opening through which said continuous fiber material passes.

7. The apparatus of claim 1 further comprising a microwave transparent insulating structure supporting said susceptor material and surrounding the processing zone and having openings at both ends so that said continuous fiber material passes therethrough during processing.

8. The apparatus of claim 7 wherein said insulating material is selected from the group consisting of: alumina, silica, mullite, zirconia, zircon, fiberglass, and mixtures thereof.

9. The apparatus of claim 1 wherein said temperature measuring device is selected from the group consisting of: contacting devices, non-contacting devices, thermocouples, resistive temperature devices, fiber optic probes, and IR detectors.

10. The apparatus of claim 1 wherein said applicator cavity further comprises damper sections to attenuate microwave energy escaping from said inlet and outlet openings.

11. The apparatus of claim 1 wherein said applicator cavity further comprises sliding plates on the wall facing said microwave launcher by which further adjustments of the cavity characteristics may be effected.

12. The apparatus of claim 1 wherein said continuous fiber material is selected from the group consisting of: tows of continuous fibers, and mats of chopped fibers.

13. A method to carbonize continuous fiber materials includes the steps of:

a) providing a microwave power source and transmission line;

b) providing a tunable microwave applicator cavity having at least one movable wall and further including an inlet opening and an outlet opening through which a continuous fiber material passes through the microwave cavity;

c) providing an open waveguide launcher through which microwave energy is delivered into the cavity;

d) positioning a body of susceptor material opposite the open waveguide launcher and spaced sufficiently therefrom to form a gap through which the fiber material passes;

e) mechanically tuning the cavity by moving at least one end wall to minimize power reflected from the cavity into the waveguide; and, f) conveying the fiber material through the cavity at a selected speed while applying microwave energy so that the fiber material is simultaneously subjected to microwave energy from the launcher and to radiant heating from the susceptor material so that a desired level of carbonization is achieved.

14. The method of claim 13 wherein said transmission line comprises a waveguide, a stub tuner, and a reflectometer comprising two couplers equipped for simultaneous measurement of forward and reverse power levels.

15. The method of claim 13 wherein said cavity has two independently movable walls, one on each end, each of said movable walls has an opening through which said continuous fiber material passes.

16. The method of claim 13 wherein said applicator cavity further comprises sliding plates on the wall facing said microwave launcher by which further adjustments of the cavity characteristics may be effected.

17. The method of claim 14 wherein step (e) comprises the steps of:

tuning said cavity at low power with the system cold, using said at least one movable wall and a vector network analyzer; and, tuning said cavity at high power with the system hot, using said stub tuners and said forward and reverse power measurements.

18. The method of claim 13 wherein said fiber material comprises polymer material that has previously been processed through a low temperature carbonization process at 600 to 1000 °C before it enters said inlet opening.

19. The method of claim 18 wherein said polymer material is selected from the group consisting of: polyacrylonitrile (PAN), pitch, rayon, polyolefins, nylon, polyethylene, cellulose, lignin, stabilized fibers of the foregoing materials, and partially carbonized fibers of the foregoing materials.

20. The method of claim 13 wherein said combined microwave energy and said radiant heating are such that said desired level of carbonization is characteristic of conventional high temperature carbonization processing.

21. The method of claim 13 wherein said combined microwave energy and said radiant heating are such that said desired level of carbonization includes at least some graphitization.

* * * * *